US006819889B2

(12) United States Patent
Okuda

(10) Patent No.: US 6,819,889 B2
(45) Date of Patent: Nov. 16, 2004

(54) IMAGE FORMING APPARATUS HAVING POWER SAVING MECHANISM

(75) Inventor: Masanori Okuda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/370,534

(22) Filed: Feb. 24, 2003

(65) Prior Publication Data

US 2003/0161647 A1 Aug. 28, 2003

(30) Foreign Application Priority Data

Feb. 28, 2002 (JP) ..... 2002-055057

(51) Int. Cl.[7] ..... G03G 15/20
(52) U.S. Cl. ..... 399/67; 399/69
(58) Field of Search ..... 399/67, 69, 88, 399/90, 328, 337; 219/216

(56) References Cited

U.S. PATENT DOCUMENTS 5,151,719 A * 9/1992 Akutsu et al. ..... 399/328
5,303,015 A * 4/1994 Sato ..... 399/69
6,243,546 B1 * 6/2001 Watanabe et al. ..... 399/69
6,466,750 B2 * 10/2002 McIntyre ..... 399/67

* cited by examiner

*Primary Examiner*—William J. Royer
(74) *Attorney, Agent, or Firm*—Takeuchi & Takeuchi

(57) ABSTRACT

An image forming apparatus having a fuser with heater for fusing a toner image formed on a print medium stops the supply of electric power to the heater when a print controlling unit detects the end of printing information, thus reducing the power consumption and preventing early degradation of the heater.

10 Claims, 12 Drawing Sheets

IMAGE FORMING APPARATUS HAVING POWER SAVING MECHANISM

BACKGROUND OF THE INVENTION

1. Field of the Invention

The present invention relates to an image forming apparatus useful for a printing device of an electro-photographic system.

2. Description of Related Art

In the printing device of the electro-photographic system, the following control has been employed for fusing the transferred toner on a print medium. First of all, a fuser is pre-heated up to such a temperature that the toner is sufficiently fused by the fuser. The fuser is pre-heated by applying electric power to an exothermic device contained therein. Then, the print medium carrying a toner image is subject to the fuser. The fuser keeps the temperature from a time when the front end of the print medium reaches the fuser till a time when the rear end of the print medium passes through the fuser. During the period of time, the print medium is heated by the fuser so that the toner image is fused. After the fusing, the application of electric power is stopped to cool the fuser.

However, in such a conventional printing device, the fuser keeps the predetermined temperature until the entire print medium passes through it. Accordingly, even if the print medium includes only a toner image, the fuser is heated until the medium passes through it. Consequently, electric power is wasted and the exothermic device is degraded earlier.

SUMMARY OF THE INVENTION

Accordingly, it is an object of the invention to provide an image forming apparatus capable of reducing the power consumption and preventing early degradation of the exothermic device.

According to the invention, there is provided an image forming apparatus comprising an image forming unit for forming a toner image onto a print medium, a fusing unit for fusing the toner image formed on the print medium and feeding the print medium, a heat generating unit for heating the fusing unit, a power supplying unit for supplying electric power to the heat generating unit, and a print controlling unit for executing printing process in accordance with an input printing information and controlling the supply of electric power to the heat generating unit. The print controlling unit detects an end of the printing information and stops the supply of electric power to the heat generating means in response to the detection of the end of the printing information.

DESCRIPTION OF THE PREFERRED EMBODIMENTS

Embodiments of the invention will now be described with reference to the accompanying drawings.

(The First Embodiment)

In the first embodiment, when image data is finished in the middle of a print medium and the remaining part of the print medium carries no image data (blank part of a paper sheet), no electric power is applied to a fuser while the blank part is subject to the fuser, thus saving electric power and preventing the degradation of an exotherinic device.

Figure 1:
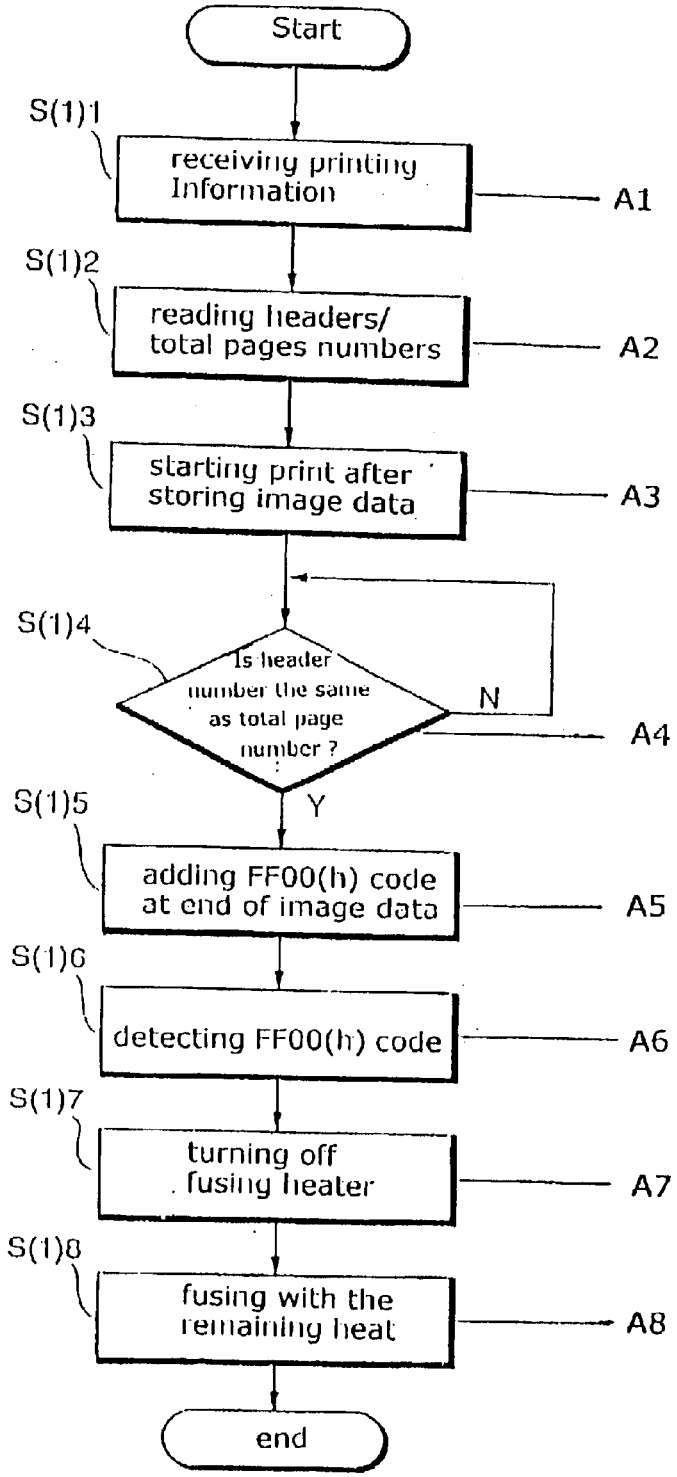
FIG. 1 is a flow chart of the first embodiment of the invention.

Steps S(1)1–S(1)8 shown in FIG. 1 are performed by an image forming apparatus according to the first embodiment which comprises a printing information receiving means A1, a header/page number reading means A2, a print starting means A3, a header/page number detecting and confirming means A4, an end code adding means A5, an end code confirming means A6, a fusing heater turn-off means A7, and a fusing means A8.

Figure 2:
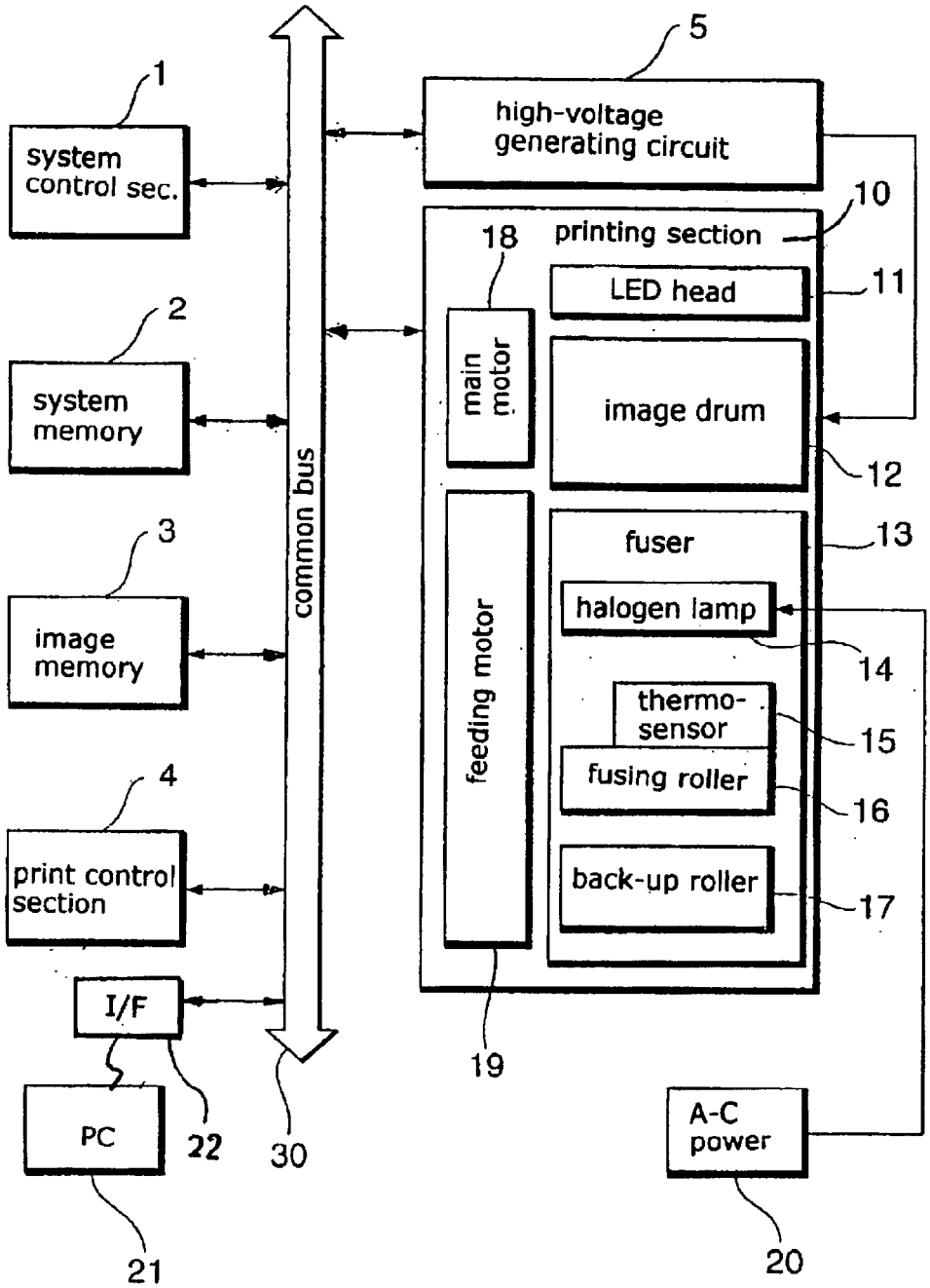
FIG. 2 is a block diagram of the construction of an image forming apparatus according to the first embodiment.

In FIG. 2, to realize each of the means, the image forming apparatus comprises a system control section 1, a system memory 2, an image memory 3, a print control section 4, a high-voltage generating circuit 5, a printing section 10, and a common bus 30. The printing section 10 includes an LED head 11, an image drum 12, a fuser 13, a main motor 18, a feeding motor 19, and an A-C power 20. The fuser 13 comprises a fusing roller 16 and a back up roller 17. A print medium is held between both the rollers 16 and 17 and fed by them. The fusing roller 16 is provided with a halogen lamp 14 to heat the toner image formed on the print medium for fusing. The formation of the toner image on the print medium is performed by the conventional electro-photographic process.

The system control section 1 (CPU) Controls the entire image forming apparatus. In the printing process, the system control section 1 mainly controls the printing information receiving means A1, header/page number reading means A2, print starting means A3, header/page number detecting and confirming means A4, and end code adding means A5. These means are usually operated according to a program pre-stored in the system memory 2. Details of each means are described below.

The Printing Information Receiving Means A1:

This is a means for receiving printing information sent from an upper-level device, such as a personal computer 21, through an interface 22. The printing information includes all information necessary for printing process, such as image data and control data.

The Header/Page Number Reading Means A2:

This is a means for analyzing the control data in the printing information and reading the number of headers and total pages included in the image data to be sent hereafter. The header is one of the control data and carries information, such as the total image data volume of each page, at the top of each page of the printing information sent from the personal computer 21.

The Print Starting Means A3:

This is a means for starting the printing process by decoding the printing information to form image data and temporarily storing the image data in the image memory 3, and reading the image data line by line in a main scanning direction. Part of the printing process is allotted to the print control section 4.

The Header/Page Number Detecting and Confirming Means A4:

This is a means for confirming, in the course of producing the image data by decoding the printing information, that the actual image data sent by the personal computer 21 is identical with the image data read by the header/page number reading means A2.

The End Code Adding Means A5:

This is a means for adding an end code at the end of the image data, when the confirming means A4 confirms that the data read by the header/page number reading means A2 is confirmed to be correct. The end code represents that there is no image data thereafter. For example, FF00 (h) is used as the end code.

The system memory 2 is composed of, for example, RAM, ROM, and/or flash memory, and stores all information including a control program required to control the image forming apparatus. The image memory 3 temporarily stores the image data that is converted from the printing information sent by the personal computer 21 and arranged page by page in the printing order. That is, the image memory acts as a buffer for the image data in the printing process and usually has the memory capacity to store one page of data.

The print control section 4 executes the printing process, according to a procedure controlled by the system control section 1, by using the LED head (exposing device) 11 for forming an electrostatic latent image on the image drum 12, a developing means (not shown in the drawings) to develop the electro-static latent image, a transferring means (not shown in the drawings) to transfer the developed image with toner to the print medium, and the fuser 13 to fuse the toner transferred onto the print medium, all of which are driven by the main motor 18 or the feeding motor 19.

In the first embodiment, the print control section 4 also functions as the end code confirming means A6, the fusing heater turn-off means A7, and the fusing means A8. The procedure is executed according to a program pre-stored in the system memory 2 in the same way as the operation of the system control section 1. Details of each means will be described.

The End Code Detecting Means A6:

This is a means for detecting the end code, FF00 (h), by monitoring the image data sent from the image memory 3.

The Fusing Heater Turn-off Means A7:

This is a means for stopping the application of a-c electric power from the A-C power 20 to the fuser 13 when the header/page number detecting and confirming means A4 detects the end code, FF00 (h). The fuser 13 comprises the halogen lamp 14, a thermosensor 15, the fusing roller 16, and the back-up roller 17.

The Fusing Means A8:

This is a means for continuing the fusing process using the remaining heat of the fuser 13 after the application of the a-c electric power to the fuser 13 is stopped. This means saves electric power consumption.

The above-described means and devices are connected to each other by the common bus 30. The upper-level device, such as the personal computer (PC) 21, is connected to the image forming apparatus through an interface such as RS232C.

As shown in FIG. 1, the image forming apparatus according to the first embodiment operates in accordance with steps S(1)1–S(1)8.

The Step S(1)1:

In FIG. 2, the printing information receiving means A1 in the system control section 1 receives the printing information sent from PC 21 through I/F 22. The printing information includes all information required in the printing process such as the image data and the control data.

The Step S(1)2:

While the system control section 1 decodes the printing information to the image data and temporarily stores it in the image memory 3, the header/page number reading means A2 analyzes the control data included in the printing data and reads the number of the headers and the number of total pages of the image data to be sent hereafter.

The Step S(1)3:

After one page, for example, of the image data is temporarily stored in the image memory 3, the print starting means A3 in the system control section 1 starts the printing process by reading out the image data line by line in the main scanning direction. The printing process is executed in cooperation with the print control section 4.

The Step S(1)4:

The header/page number detecting and confirming means A4 in the system control section 1 continues to confirm, in the course of producing the image data by decoding the printing information, that the actual image data sent by the personal computer 21 is identical with the data read by the header/page number reading means A2, and detects the end of the image data. When all the image data obtained by decoding the printing information is confirmed to be identical with the actual image data, the process advances to the next step.

The Step S(1)5:

The end code adding means A5 in the system control section 1 adds the end code FF00 (h) to the end of the image data. The end codes represents that there is no image data coming thereafter.

The Step S(1)6:

End code detecting means A6 in the print control section 4 monitors the image data sent from the image memory 3, and when the LED head 11 detects the end code FF00 (h), the process advances to the next step.

The Step S(1)7:

The fusing heater turn-off means A7 in the print control section 4 stops the supply of a-c electric power from the A-C power 20 to the fuser 13.

The Step S(1)8:

The fusing means A8 in the print control section continues to fuse the remaining toner-transferred portion to complete the whole flow, using the remaining heat after the stop of the power supply.

The above-described operation is usually executed according to the system program that is pre-stored in the system memory 2. However, the invention is not limited to that. An individual control circuit for each means may be employed to execute the process. The respective means are grouped to either the system control section 1 or the print control section 4 to simplify the description. However, each means may not be clearly grouped to either control section, because both the control sections operate integrally as a unit.

(Effects of the First Embodiment)

The image forming apparatus according to the first embodiment eliminates the fusing in the blank part of a sheet in the end of the page and, therefore, has the following effects.

(1) It is possible to reduce the power consumption.

(2) It is possible to lengthen the life of a halogen lamp 14 used in the fuser 13.

(The Second Embodiment)

In the first embodiment, if the print medium is very thick or it is very low temperature around the image forming apparatus, the toner may not be sufficiently fused by the remaining heat of the fuser 13. The second embodiment is made to solve such a problem.

Figure 3:
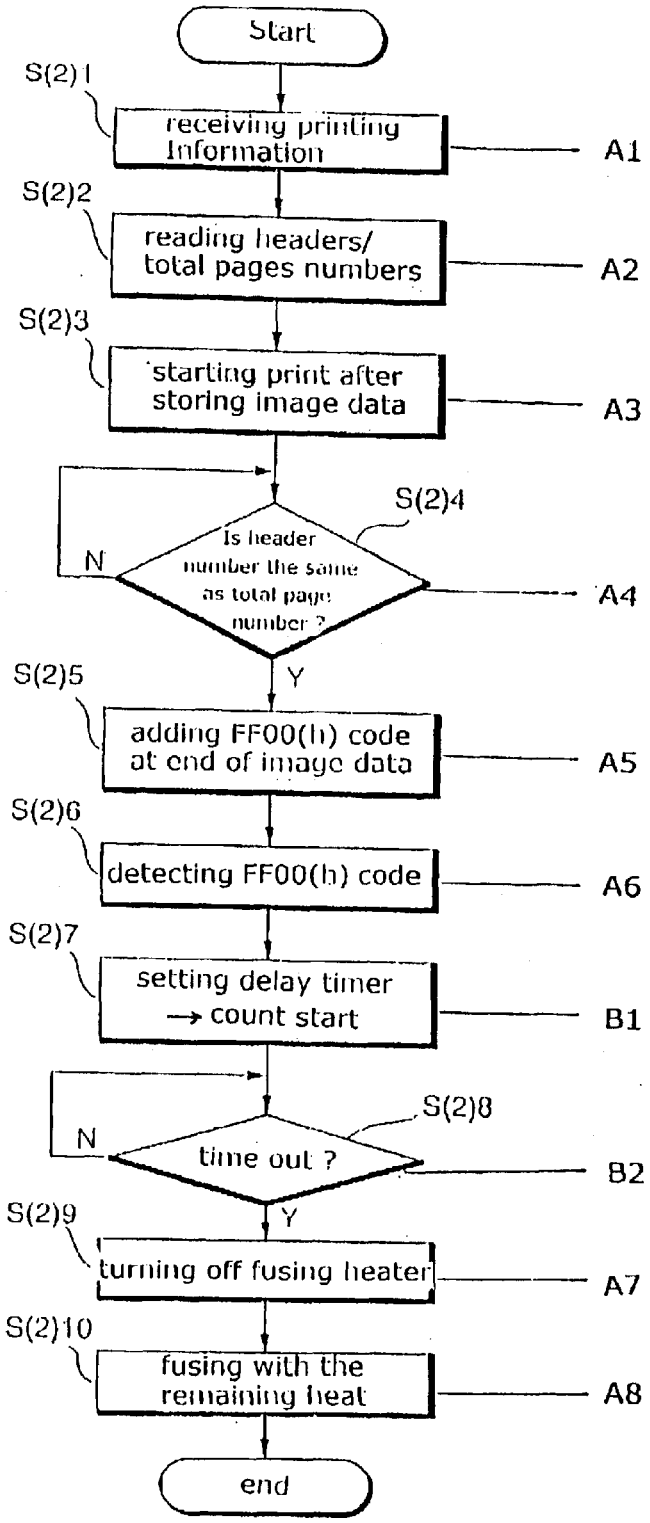
FIG. 3 is a flow chart of the second embodiment of the invention.

Steps S(2)1–S(2)10 shown in FIG. 3 are performed an image forming apparatus according to the second embodiment which comprises a printing information receiving means A1, a header/page number reading means A2, a print starting means A3, a header/page number detecting and confirming means A4, an end code adding means A5, an end code confirming means A6, a delay timer setting and count starting means B1, a time-out monitoring means B2, a fusing heater turn-off means A7, and a fusing means A8.

Figure 4:
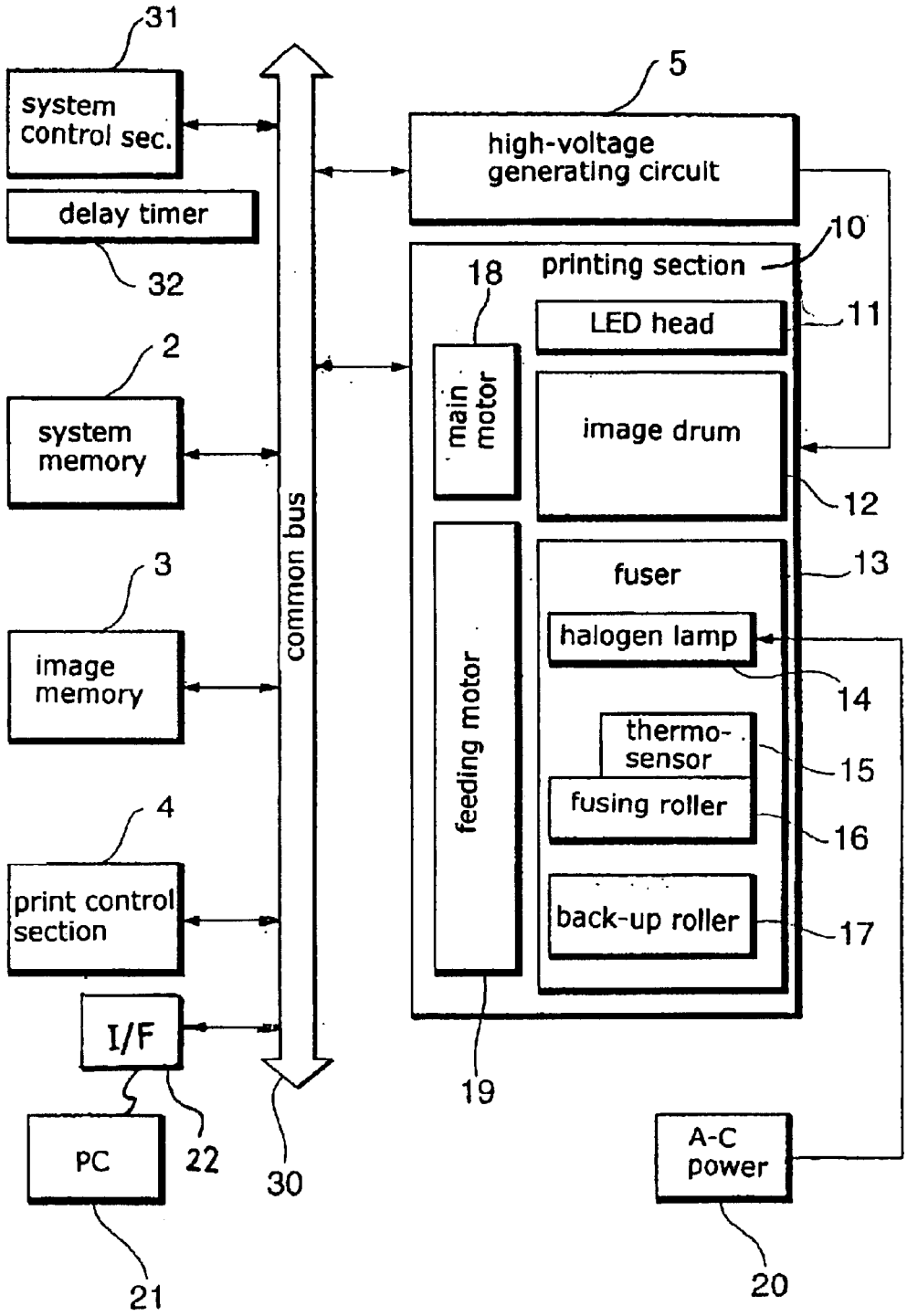
FIG. 4 is a block diagram of the construction of an image forming apparatus according to the second embodiment.

In FIG. 4, to realize each of the means, the image forming apparatus comprises a system memory 2, an image memory 3, a print control section 4, a high-voltage generating 5, a printing section 10, an A-C power 20, a common bus 30, a system control section 31, and a delay timer 32. The printing section 10 includes an LED head 11, an image drum 12, a fuser 13, a main motor 18, and a feeding motor 19. The only difference from the first embodiment will be described below.

The system control section 31 (CPU) controls the entire image forming apparatus. In the printing process, it mainly controls the printing information receiving means A1, header/page number reading means A2, print starting means A3, header/page number detecting and confirming means A4, end code adding means A5, delay timer setting and count starting means B1, and time-out monitoring means B2. These means are operated according to a program pre-stored in the system memory 2. Details of the respective means are described below.

The Delay Timer Setting and Count Starting Means B1:

This is a means for setting a predetermined value in the delay timer 32 to start counting when the end code detecting means A6, which monitors the image data sent from the image memory 3, detects the end code FF00 (h). It is preferred that the delay timer 32 has a decrement system that the predetermined value is decreased after it is set. The predetermined value "t" is the period of time required for fusing the image after the image data is sent to the LED head 11. If a (mm) is the distance from the first point on the image drum 12 to which the LED head 11 applies light to the second point on the print medium at which toner is transferred, b (mm) is the distance from the second point to the third point at which the fusing is performed, and V (mm/sec) is the moving speed of the print medium (=the revolution speed of the image drum 12), the period time determined by the formula, $t=[(a+b)/v]$ sec. However, it is preferable that the predetermined value is adjusted according to the kind of the print medium.

The Time-Out Monitoring Means B2:

This is a means for monitoring the delay timer 32 from counting start to time-out. The delay timer 32 delays the operation of the fusing heater turn-off means A7 by the predetermined value t. When the end code detecting means A6 detects the end code FF00 (h), the predetermined value t is set and, when the predetermined value t is decreased to zero, the fuser 13 is turned off. The predetermined value may be set at such a value that it ends after the time at which the end of the toner transferred on the print medium passes through the fuser 13 but before the time at which the print medium passes through the fuser 13.

The image forming apparatus is operated according to steps S(2)1–S(2)10 shown in FIG. 3. The steps S(2)1–S(2)6 are identical with the steps S(1)1–S(1)6 and the description thereof will be omitted.

The Step S(2)7:

When the end code detecting means A6 in the print control section 4 monitors the image data sent from the image memory 3 and detects the end code FF00 (h), the system control section 31 sets the predetermined value in the delay timer 32 and makes the delay timer 32 start counting.

The Step S(2)8:

The time-out monitoring means B2 in the system control section 31 continues to monitor the delay timer 32 and confirms the time-out.

The Step S(2)9:

The fusing heater turn-off means A7 in the print control section 4 stops the supply of a-c electric power from the A-C power 20 to the fuser 13.

The step S(2)10:

The fuser 13 in the print control section 4 simply feeds the blank part of the print medium without fusing because the supply of power to the fuser 13 has been stopped after the toner image on the print medium passes through the fuser 13. Since no electric power is applied to the fuser 13 for the blank part, the power consumption is reduced.

The above-described operation is usually executed according to the system program that is pre-stored in the system memory 2. However, the invention is not limited to that. An individual control circuit for each means may be employed to execute the process. The respective means have been grouped to either the system control section 31 or the print control section 4 to simplify the description. However, each means may not be clearly classified to either control section, because both the control sections operate integrally as a unit.

(Effects of the Second Embodiment)

Since the image forming apparatus according to the second embodiment can be adjusted in accordance with the kind of the print medium and peripheral environment of the image forming apparatus, firm fusing is achieved in addition to the result obtained by the first embodiment.

(The Third Embodiment)

When the printing information sent from the PC or upper-level device 21 includes a large volume of information, such as a drawing, the image data is not continuously transferred because the decoding process requires a long time. In such a case, in the first and second embodiments, the supply of electric power to the fuser 13 is stopped in the middle because it is judged as the end of the image data. When this happens, large electric power is necessary to raise the temperature of the fuser again. The third embodiment has the following construction to solve, this problem.

Figure 5:
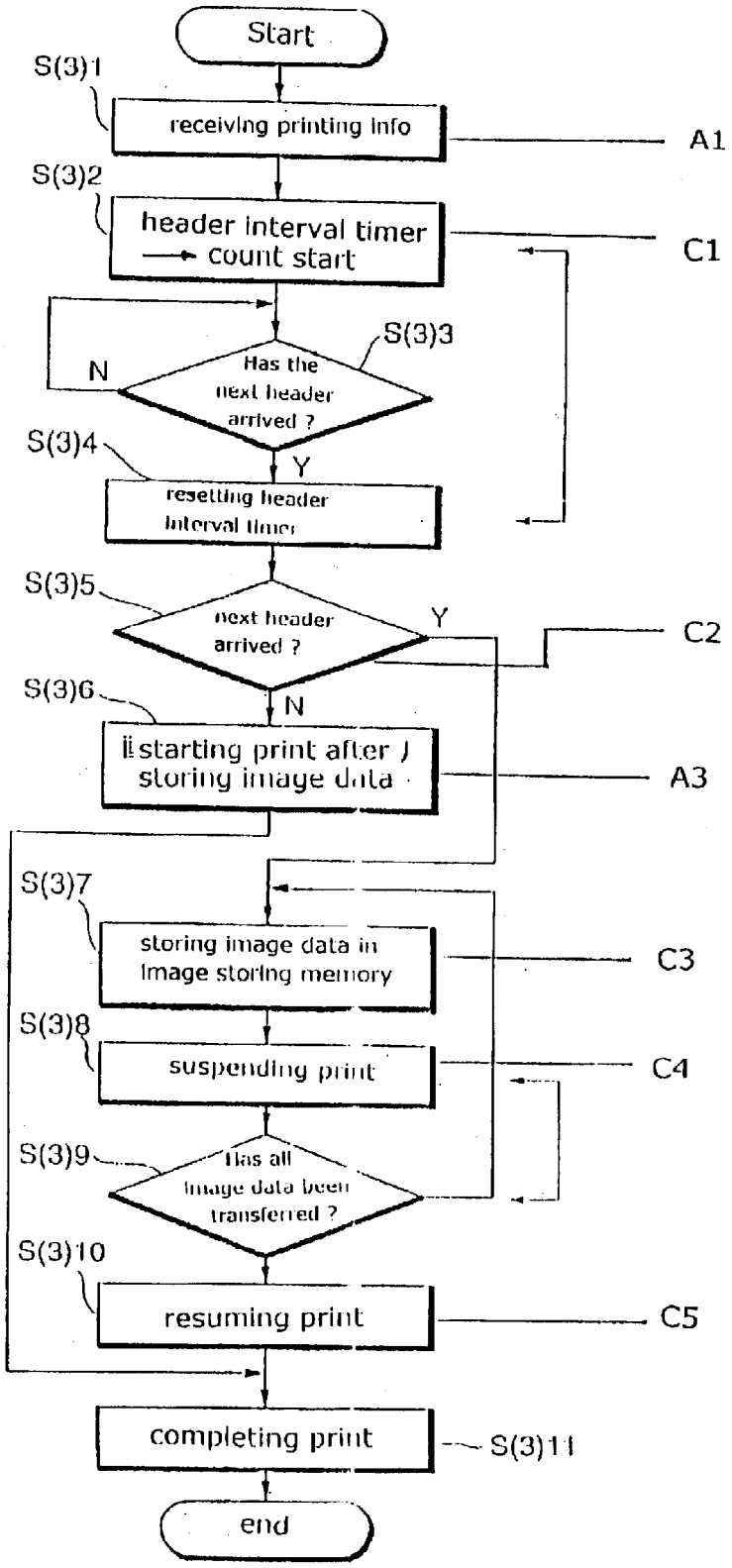
FIG. 5 is a flow chart of the third embodiment of the invention.

Steps S(3)1–S(3)10 shown in FIG. 5 are performed by the image forming apparatus according to the third embodiment which comprises a printing information receiving means A1, a header interval measuring means C1, a header interval evaluating means C2, a print starting means A3, a memory changing means C3, a print stopping means C4, and a print resuming means C5.

Figure 6:
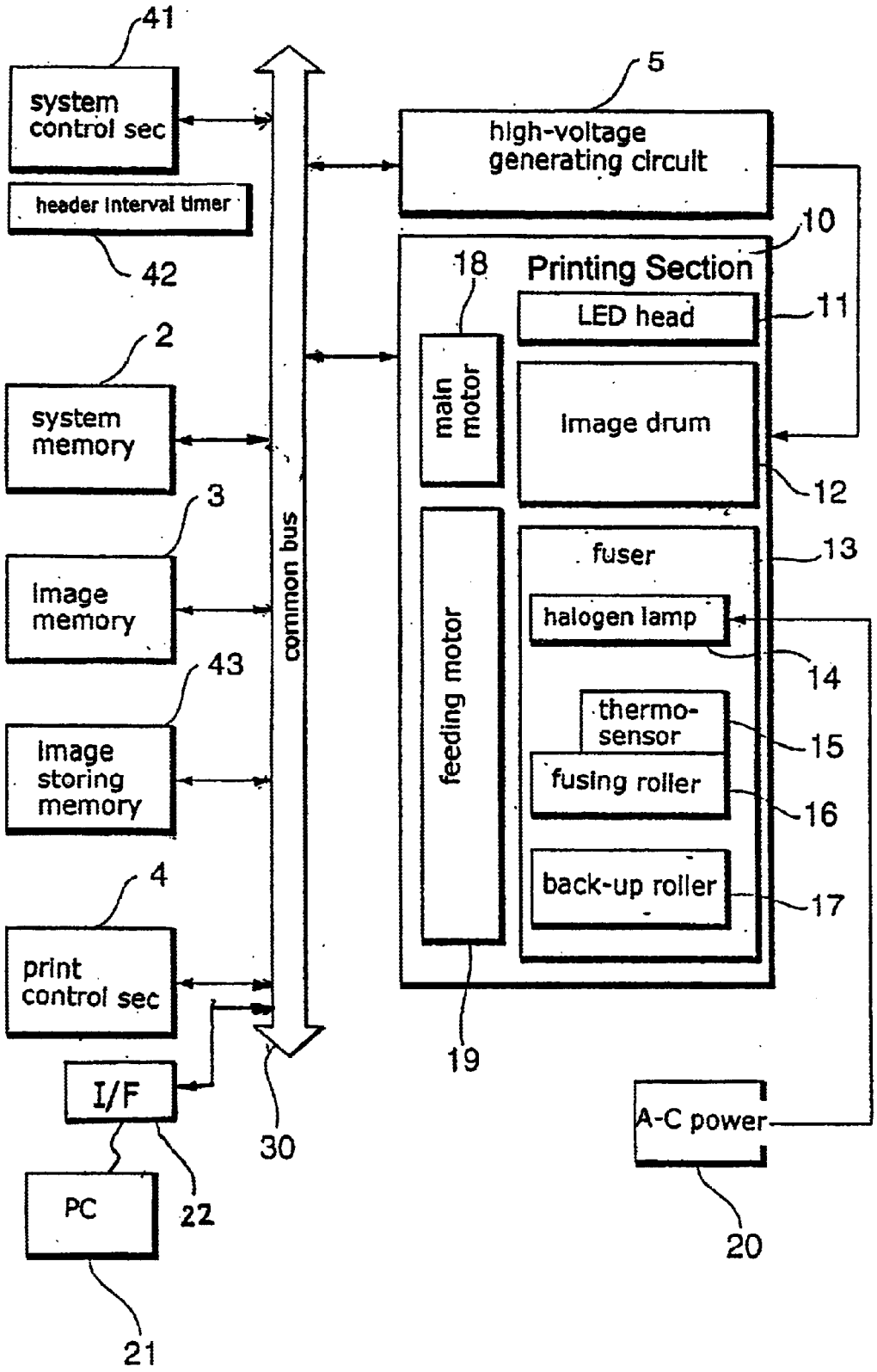
FIG. 6 is a block diagram of the construction of an image forming apparatus according to the third embodiment.

In FIG. 6, to realize each of the means, the image forming apparatus comprises a system memory 2, an image memory 3, a print control section 4, a high-voltage generating section circuit 5, a printing section 10, an A-C power 20, a common bus 30, a system control section 41, a header interval timer 42, and an image storing memory 43. The printing section 10 includes an LED head 11, an image drum 12, a fuser 13, a main motor 18, and a feeding motor 19. The only difference from the second embodiment will be described below.

The system control section 41 (CPU) controls the entire image forming apparatus. In the printing process, it mainly controls the printing information receiving means A1, header interval measuring means C1, header interval evaluating means C2, print starting means A3, memory changing means C3, print suspending means C4, and print resuming means C5. These means are operated according to a program pre-stored in the system memory 2. Details of the respective means are described below.

The Printing Information Receiving Means A1:

This is a means for receiving printing information from an upper-level device, such as a personal computer 21, through an interface 22. The printing information includes all information necessary for the printing process, such as image data and control data.

The Header Interval Measuring Means C1:

This is a means for, when a header comes, making the header interval timer 42 turn on to start counting, and when the next header comes, reading the number of the count counted by the header interval timer 42 to measure the header interval and resetting the header interval timer 42 to prepare for the next measurement.

The Header Interval Evaluating Means C2:

This is a means for judging which of the header interval measured by the header interval timer 42 and a predetermined interval is larger. For the value of the predetermined interval, an interval between the time when the front end of a print medium comes and the time when the front end of the next print medium comes, is used on the assumption that there is no intermitted part in the image data and the entire print medium is printed.

The Print Starting Means A3:

This is a means for starting the printing process by decoding the printing information to produce the image data, temporarily storing the image data in the image memory 3, and reading the image data stored in the image memory 3 line by line in a main scanning direction. Part of the printing process is allotted to the print control section 4.

The memory changing means C3:

This is a means for storing the image data in the image storing memory 43 instead of the image memory 3 so as to avoid intermitted transmission of the image data caused by long-time decoding. That is, while the printing process is suspended, all the printing information is decoded to the image data and once stored in the image storing memory 43 having large capacity, then, the image data is read out from the image storing memory 43, thereby to avoid the intermission of the image data.

The Print Suspending Means C4:

This is a means for temporarily stopping the printing process while the image data is stored in the image storing memory 43 instead of the image memory 3.

The Print Resuming Means C5:

This is a means for resuming the printing process after all the printing information is decoded to the image data and stored in the image storing memory 43.

The header interval timer 42 measures the interval between a certain header and the next header immediately following thereafter. The image storing memory 43 has a large memory capacity capable of storing whole pages of image data. It is preferable that the image storing memory 43 can store 10 to 100 sheets of A4 paper. A hard disc, for example, is used as the image storing memory 43. The other devices are identical with those of the first embodiment and the description thereof will be omitted.

As shown in FIG. 5, the image forming apparatus according to the third embodiment is operated in accordance with steps S(3)–3(3)11.

The Step S(3)1:

The printing information receiving means A1 in the system control section 41 receives the printing information sent from the PC 21 through the I/F 22. The printing information includes all information required in the printing process such as the image data and the control data.

The Step S(3)2:

The header interval measuring means C1 in the system control section 41 makes the header interval timer 42 turned on to start counting when a header comes.

The Step S(3)3:

The header interval measuring means C1 makes the header interval timer 42 increase the count and waits for the arrival of the next header.

The Step S(3)4:

When the next header arrives, the header interval measuring means C1 reads the number of the count to measure the header interval and resets the header interval timer 42 to be prepared for the next measurement.

The Step S(3)5:

The header interval evaluating means C2 judges which of the header interval measured by the header interval timer 42 and the predetermined interval is larger. If the measured interval is larger than the predetermined interval, the process will jump to the step S(3)7, and in the other cases, the process will advance to the next step S(3)6:

The Step S(3)6:

The print starting means A3,in the system control section 41 starts the printing process by decoding the received printing information to produce the image data, temporarily storing the image data in the image memory 3, and reading out the image data line by line in the main scanning direction. The printing process is executed in cooperation with the print control section 4.

The Step S(3)7:

The memory changing means C3 in the system control section 41 stores the image data in the image storing memory 43 instead of the image memory 3.

The Step S(3)8:

The print suspending means C4 in the system control section 41 suspends the printing process while the image data is stored in the image storing memory 43 instead of the image memory 3.

The Step S(3)9:

The print suspending means C4 advances the process to the next step after all the image data is stored in the image storing memory 43.

The step S(3)10:

The print resuming means C5 in the system control section 41 resumes the printing process after all the printing information is decoded to the image data and stored in the image storing memory 43.

The Step S(3)11:

All the printing process is finished and the flow ends.

The above-described operation is usually executed according to the system program that is pre-stored in the system memory 2. However, the invention is not limited to that. An individual control circuit for each means may be employed to execute the process. The respective means have been grouped to either the system control section 41 or the control section 4 to simplify the description. However, each means may not be clearly classified to either control section, because both the control sections operate integrally as a unit.

(Effects of the Third Embodiment)

The image forming apparatus according to the third embodiment has the same effects as those of the first and second embodiments even if the image data of the printing information sent from the upper-level device 21 is not continuously transmitted due to long-time decoding.

(The Fourth Embodiment)

The third embodiment describes the case that the image data may not be continuously transmitted because of long-time decoding. The fourth embodiment describes the case that the image data is not continuously transmitted with very high probability because of, for example, a facsimile transmission.

Figure 7:
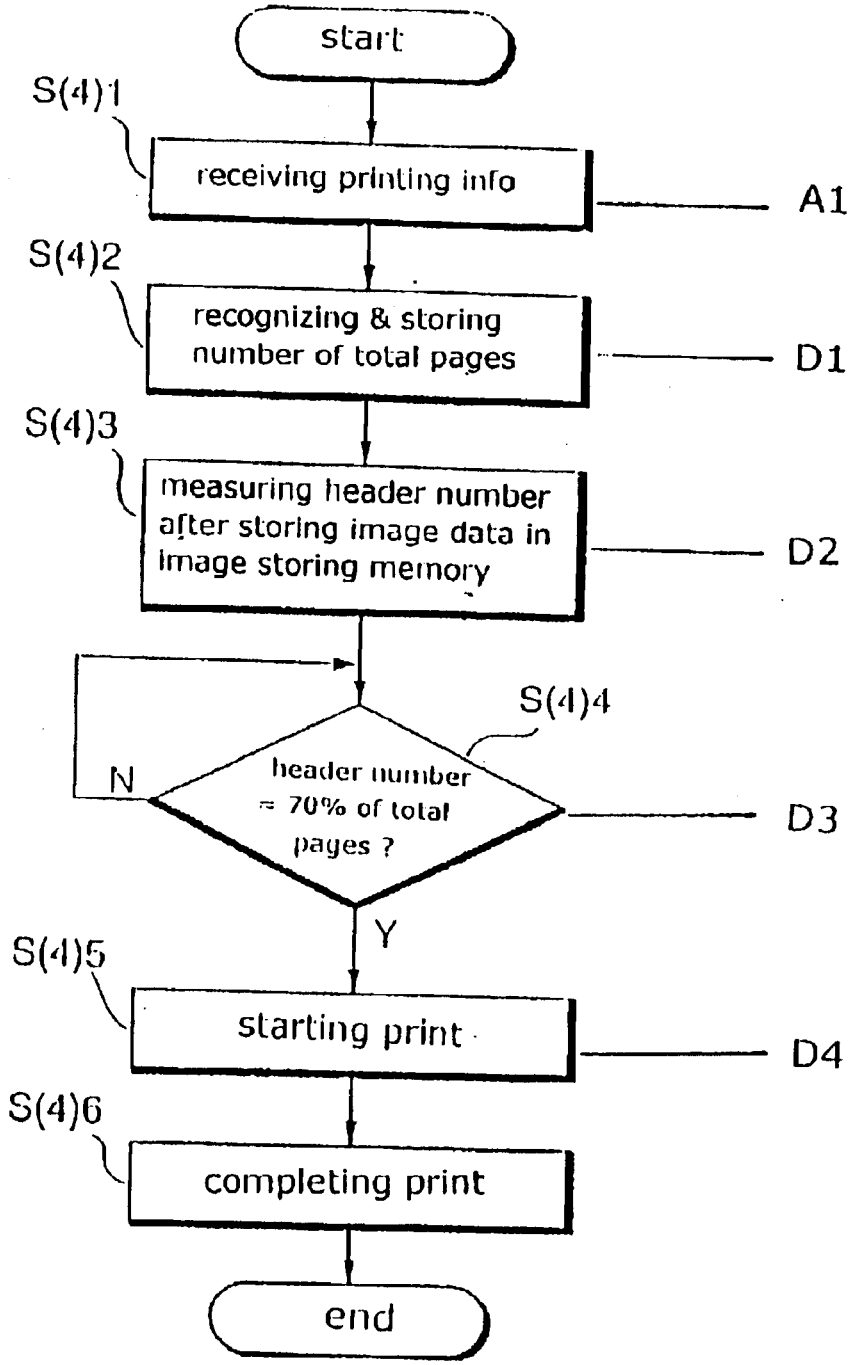
FIG. 7 is a flow chart of the fourth embodiment of the invention.

Steps S(4)1–S(4)6 shown in FIG. 7 are performed by the image forming apparatus according to the fourth embodiment which comprises a printing information receiving means A1, a total page number recognizing and memorizing means D1, a header number measuring means D2, an accumulated image data volume monitoring means D3, and a print starting means D4 by an image storing memory 43.

Figure 8:
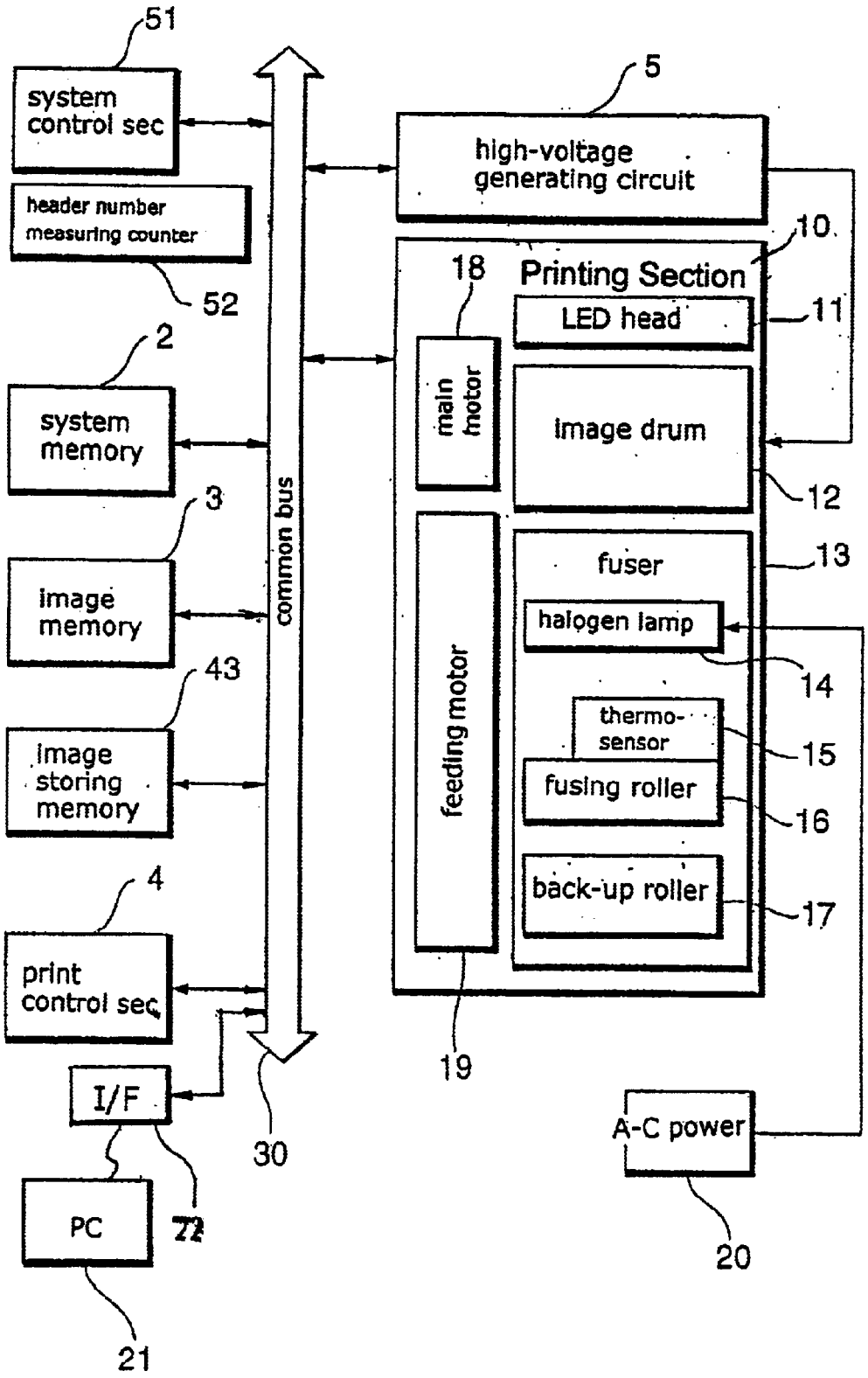
FIG. 8 is a block diagram of the construction of an image forming apparatus according to the fourth embodiment.

In FIG. 8, the image forming apparatus comprises a system memory 2, an image memory 3, a print control section 4, a high-voltage generating circuit 5, a printing section 10, an A-C power 20, a common bus 30, an image storing memory 43, a system control section 51, and a header number measuring counter 52. The printing section 10 includes an LED head 11, an image drum 12, a fuser 13, a main motor 18, and a feeding motor 19. The only difference from the third embodiment will be described below.

The system control section 51 (CPU) controls the entire image forming apparatus according to the third embodiment. In the printing process, it mainly controls the printing information receiving means A1, header number measuring means D2, accumulated image data volume monitoring means D3, and print starting means D4 by the image storing memory 43. The means are operated according to a program pre-stored in the system memory 2. Details of the respective means are described below.

The Printing Information Receiving Means A1:

This is a means for receiving the printing information sent by the upper-level device, such as the personal computer 21, through the interface 22. The printing information includes all information necessary for the printing process such as the image data and the control data.

The Total Page Number Recognizing and Memorizing Means D1:

This is a means for analyzing the control data in the printing information and reading the numbers of headers and total pages included in the image data to be sent hereafter. The header is one of the control data and carries information, such as the total volume of the image data of each page, at the top of each page of the printing information sent from the personal computer 21. The means also memories the numbers of the headers and total pages.

The Header Number Measuring Means D2:

This is a means for making the header number measuring counter 52 increase the count by one every time one page of the image data is stored in the image storing memory 43 to measure the number of pages of the image data currently stored.

The Accumulated Image Data Volume Monitoring Means D3:

This is a means for monitoring whether the volume of the accumulated image data has reached a predetermined value, judging from the number of the count measured by the header number measuring counter 52. For the predetermined value, to avoid the intermission of the printing process, such a value that permits additional accumulation of the image data currently not accumulated in the image storing memory 43 before completing the print of all the image data already accumulated in the image storing memory 43. For example, 70% of the total image data volume is used for the predetermined value.

The Print Starting Means D4 by the Image Storing Memory:

This is a means for starting the printing process by decoding the printing information to produce the image data, storing the image data in the image storing memory 43, and reading the image data line by line in a main scanning direction. Part of the printing process is allotted to the print control section 4. The header number measuring counter 52 increases the count by one every time one page of the image data is stored in the image storing memory 43 to memorize the total page of the image data currently stored. The other means are the same as those of the third embodiment and the description thereof will be omitted.

In FIG. 7, the image forming apparatus according to the fourth embodiment operates in accordance steps S(4)1–S(4)6.

The Step S(4)1:

The printing information receiving means A1 in the system control section 51 receives the printing information sent by the upper-level device such as the personal computer 21. The printing information includes all information necessary for the printing process such as the image data and the control data.

The Step S(4)2:

The total page number recognizing and memorizing means D1 in the system control section 51 decodes the printing information to produce the image data, accumulates the image data in the image storing memory 43, analyzes the control data in the printing information, and reads and memorizes the numbers of headers and total pages included in the image data to be sent hereafter.

The Step S(4)3:

The header number measuring means D2 in the system control section 51 makes the header number measuring counter 52 increase the count by one every time one page of the image data is stored in the image storing memory 43 to measure the number of pages of the image data currently stored.

The Step S(4)4:

The accumulated image data volume monitoring means D3 in the system control section 51 monitors whether the volume of the accumulated image data has reached the predetermined value (for example, 70% of total pages of the image data). When the accumulated volume reaches the predetermined value, the process advances to the next step.

The Step S(4)5:

The print starting means D4 by the image storing memory starts the printing process by decoding the printing information to produce the image data, storing the image data in the image storing memory 43, and reading the image data stored in the image data storing memory 43 line by line in a main scanning direction. Part of the printing process is allotted to the print control section 4.

The Step S(4)6:

When all the image data is printed, the flow ends.

The above-described operation is executed according to a system program pre-stored in the system memory 2. However, the invention is not limited to that. An individual control circuit for each means may be employed to execute the process. The respective means have been grouped to either the system control section 51 or the print control section 4 to simplify the description. However, each means may not be clearly grouped to either control section, because both the control sections operate integrally as a unit.

(Effects of the Fourth Embodiment)

Even if it is assumed that the printing information is not continuously transmitted with high probability due to the kind of the upper-level device, such as a facsimile machine, the image forming apparatus according to the fourth embodiment has the same effects as those of the first and second embodiments by starting the printing process after all the image data is once stored in the image storing memory 43.

(The Fifth Embodiment)

The fifth embodiment describes the case that the image forming apparatus according to the first embodiment is used with a facsimile.

Figure 9:
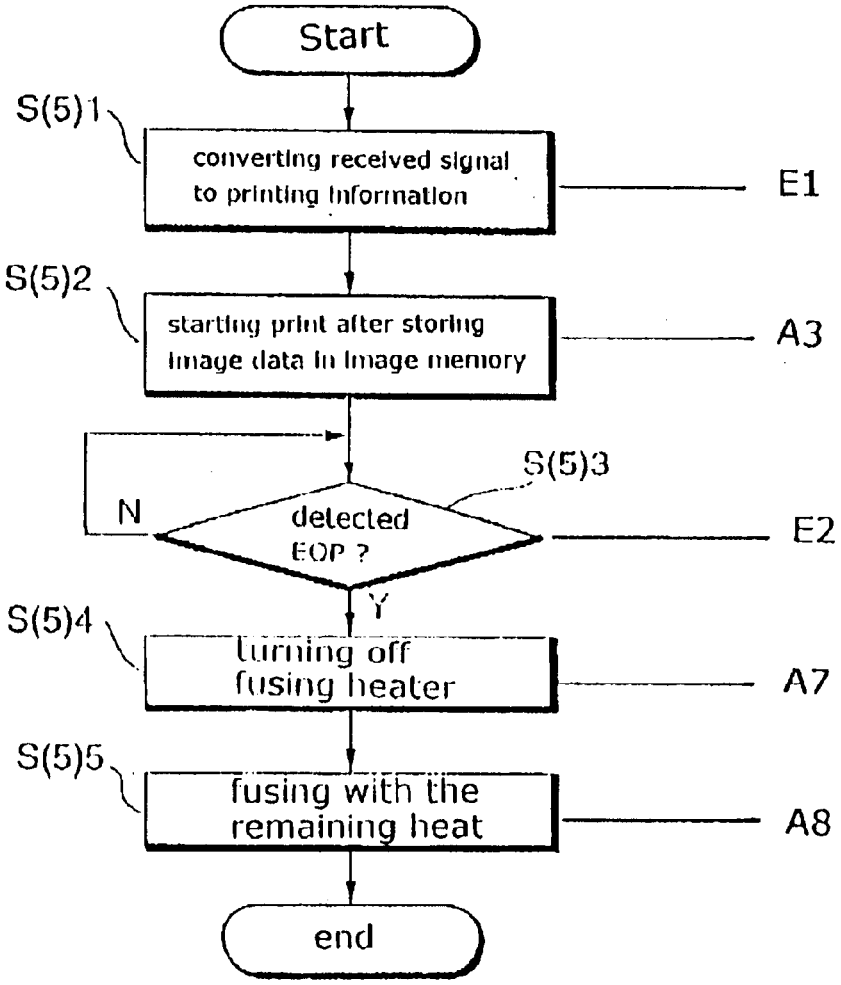
FIG. 9 is a flow chart of the fifth embodiment of the invention.

Steps S(5)1–S(5)5 shown in FIG. 9 are performed by the image forming apparatus according to the fifth embodiment which comprises an input signal converting means E1, a print starting means A3, an EOP signal detecting means E2, a fusing heater turn-off means A7, and a fusing means A8.

Figure 10:
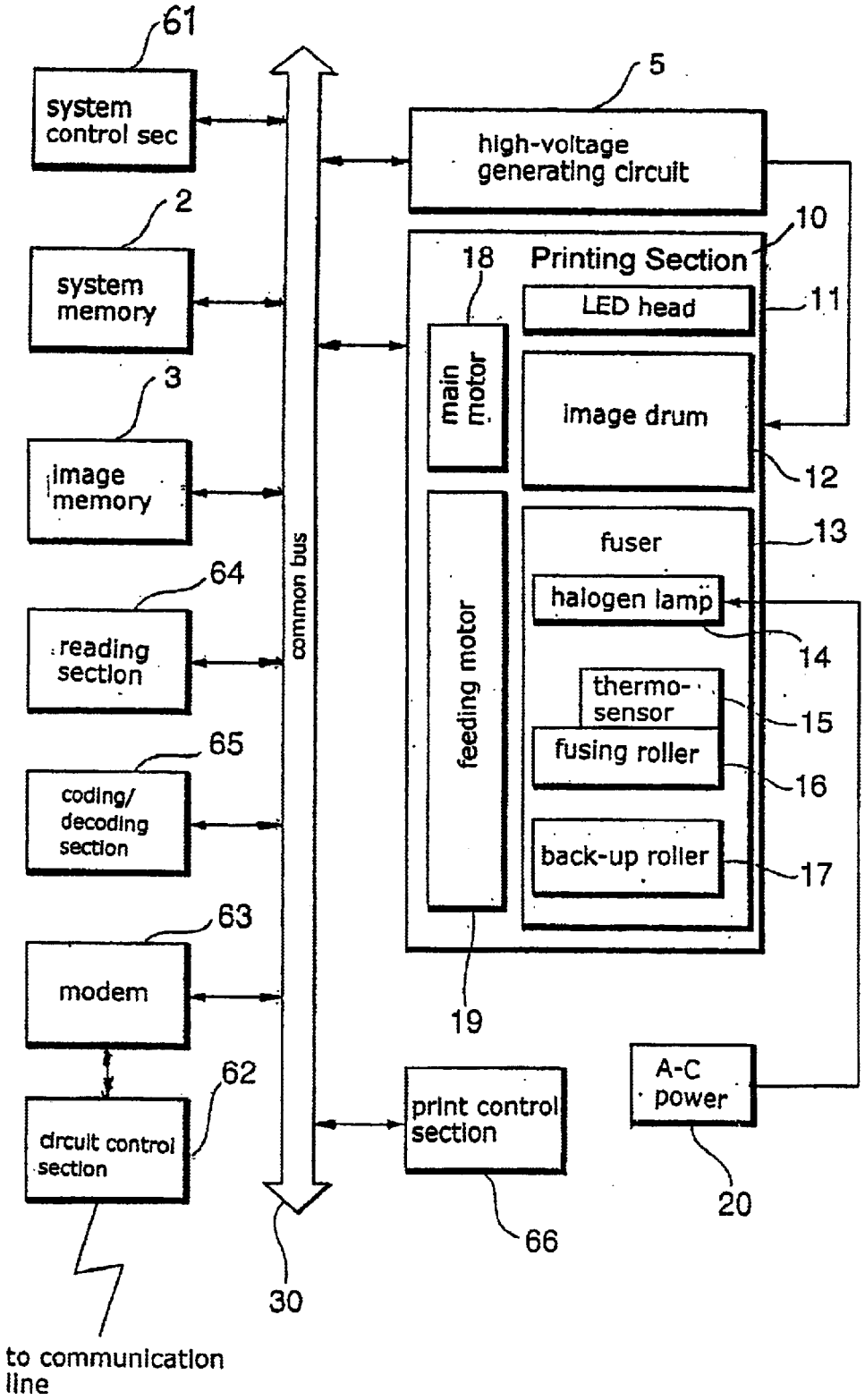
FIG. 10 is a block diagram of the construction of an image forming apparatus according to the fifth embodiment.

In FIG. 10, to realize each of the means, the image forming apparatus comprises a system memory 2, an image memory 3, a high-voltage generating circuit 5, a printing section 10, an A-C power 20, a common bus 30, a system control section 61, circuit control section 62, a modem 63, a reading section 64, a coding/decoding section 65, and a print control section 66. The printing section 10 includes an LED head 11, an image drum 12, a fuser 13, a main motor 18, and a feeding motor 19. The only difference from the first embodiment will be described below.

The system control section 61 (CPU) controls the entire image forming apparatus according to the third embodiment. In the printing process, it mainly controls the input signal converting means E1, print starting means A3, and EOP signal detecting means E2. The means are operated according to a program pre-stored in the system memory 2. Details of individual means are described below.

The Input Signal Converting Means E1:

This is a means for receiving a facsimile communication signal that is modulated with a transmission carrier wave and sent from a partner's facsimile machine, demodulating the modulated signal, and converting the demodulated signal to the printing information.

The Print Starting Means A3:

This is a means for starting the printing process by decoding the printing information to produce the image data, temporarily storing the image data in the image memory 3, and reading out the image data line by line in a main scanning direction. Part of the printing process is allotted to the print control section 66.

The EOP Signal Detecting Means E2:

This is a means for monitoring and detecting that EOP (end of transmission) signal arrives at the coding/decoding section 65. The EOP signal has the same function as the end code in the first embodiment.

The circuit control section 62 is connected to a communication line to transmit the facsimile communication signal from the modem 63 to the communication line and transfer the facsimile communication signal from the communication line to the modem 63. Also, this means works as a part of the input signal converting means E1.

The modem 63, when sending, modulates the coded data from the coding/decoding section 65 to the facsimile communication signal by using a predetermined carrier wave and, when receiving, demodulates the facsimile communication signal received from the circuit control section 62 to the coded data and sends it to the coding/decoding section 65.

The reading section 64 reads a manuscript and converts an analog signal of the manuscript to a digital signal when sending a facsimile or making a copy. The coding/decoding section 65 codes the digital signal received from the reading section 64 to a code that is required for the facsimile communication, and converts the coded data received from the modem 63 to the printing information.

The print control section 66 executes the printing process, according to a procedure controlled by the system control section 61, by using the main motor 18 and the feeding motor 19 to drive the LED head (exposing device) 11 for forming an electro-static latent image on the image drum 12, a developing means (not shown in the drawings) to develop the electro-static latent image, a transferring means (not shown in the drawings) to transfer the developed image with toner to the print medium, and the fuser 13 to fuse the toner transferred onto the print medium.

In the fifth embodiment, the print control section 66 also functions as the fusing heater turn-off means A7 and the fusing means A8. These means are operated according to a program pre-stored in the system memory 2 in the same way as in the system control section 61. Details of each means will be described.

The Fusing Heater Turn-Off Means A7:

This is a means for stopping the supply of a-c electric power from the A-C power 20 to the fuser 13 in response to the detection by the EOP signal detecting means E2, of the arrival of the EPO signal at the coding/decoding section 65. The fuser 13 comprises a halogen lamp 14, a thermosensor 15, a fusing roller 16, and a back-up roller 17.

The Fusing Means A8:

This is a means for continuing a fusing process by using the remaining heat of the fuser 13 after the supply of power to the fuser 13 is stopped, thereby to reduce the power consumption. The other means are the same as those of the first embodiment and the description thereof will be omitted.

In FIG. 9, the image forming apparatus according to the fifth embodiment is operated in accordance with steps S(5)1–S(5)5.

The Step S(5)1:

The system control section 61 controls the modem 63 to demodulate the facsimile communication signal that is modulated with a carrier wave and sent from a partner's facsimile machine, decodes the signal, and converts it to the printing information.

The Step S(5)2:

The system control section 61 starts the printing process by producing the image data from the printing information received from the coding/decoding section 65, temporarily storing the image data in the image memory 3, and reading out the image data line by line in the main scanning direction. Part of the printing process is allotted to the print control section 66.

The Step S(5)3:

The EOP signal detecting means E2 in the system control section 61 monitors the arrival of the EOP signal at the coding/decoding section 65 and when the arrival is detected, the process advances to the next step.

The Step S(5)4:

The fusing heater turn-off means A7 in the print control section 66 stops the supply of a-c electric power to the fuser 13.

The Step S(5)5:

The fusing means A8 in the print control section 66 continues to fuse the remaining part by using the remaining heat of the fuser 13 after the supply of power to the fuser 13 is stopped.

The above-described operation is usually executed according to the system program that is pre-stored in the system memory 2. However, the invention is not limited to that. An individual control circuit for each means may be employed to execute the process. The respective means have been grouped to either the system control section 61 or the print control section 66 to simplify the description. However, each means may not be clearly grouped to either control section, because both the control sections operate integrally as a unit.

(Effects of the Fifth Embodiment)

The image forming apparatus according to the fifth embodiment has the same effects as those of the first embodiment, even if the apparatus is used with a facsimile machine, by employing the EOP signal instead of the end code added at the end of the image data in the first embodiment. In the fifth embodiment, when tfie EOP signal is detected, the supply of a-c electric power to the fuser 13 is immediately stopped. However, the supply of power to the fuser 13 may be stopped at a predetermined time after the detection of the EOP signal by using the same construction as that in the second embodiment.

(The Sixth Embodiment)

The sixth embodiment describes the case that the image forming apparatus in the third embodiment is used with a facsimile machine.

Figure 11:
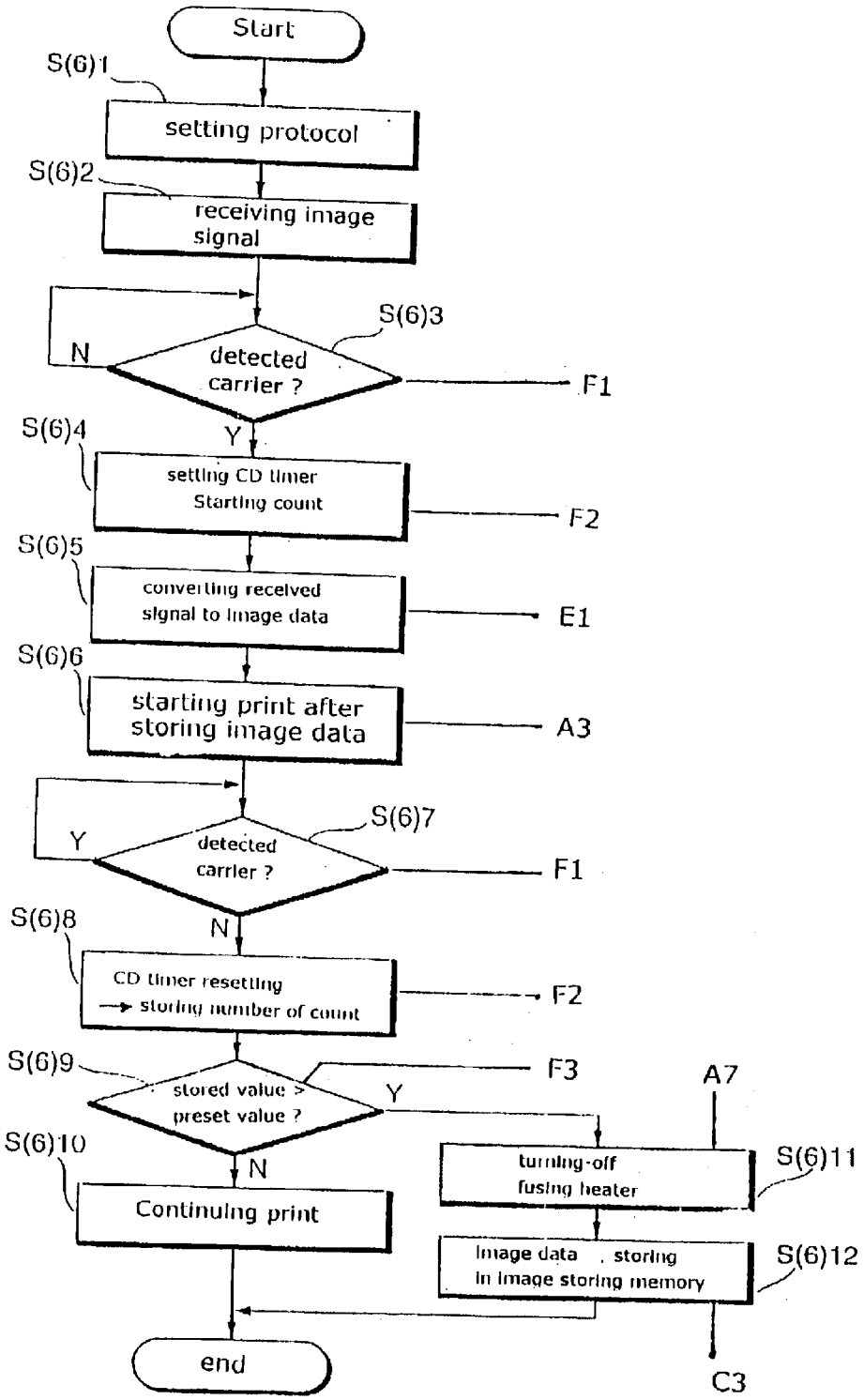
FIG. 11 is a flow chart of the sixth embodiment of the invention.

Steps S(6)1–S(6)12 shown in FIG. 11 are performed by the image forming apparatus according to the sixth embodiment which comprises a carrier detecting means F1, CD continuation time measuring means F2, an input signal converting means E1, a print starting means A3, a CD continuation time evaluating means F3, a fusing heater turn-off means A7, and a memory changing means C3.

Figure 12:
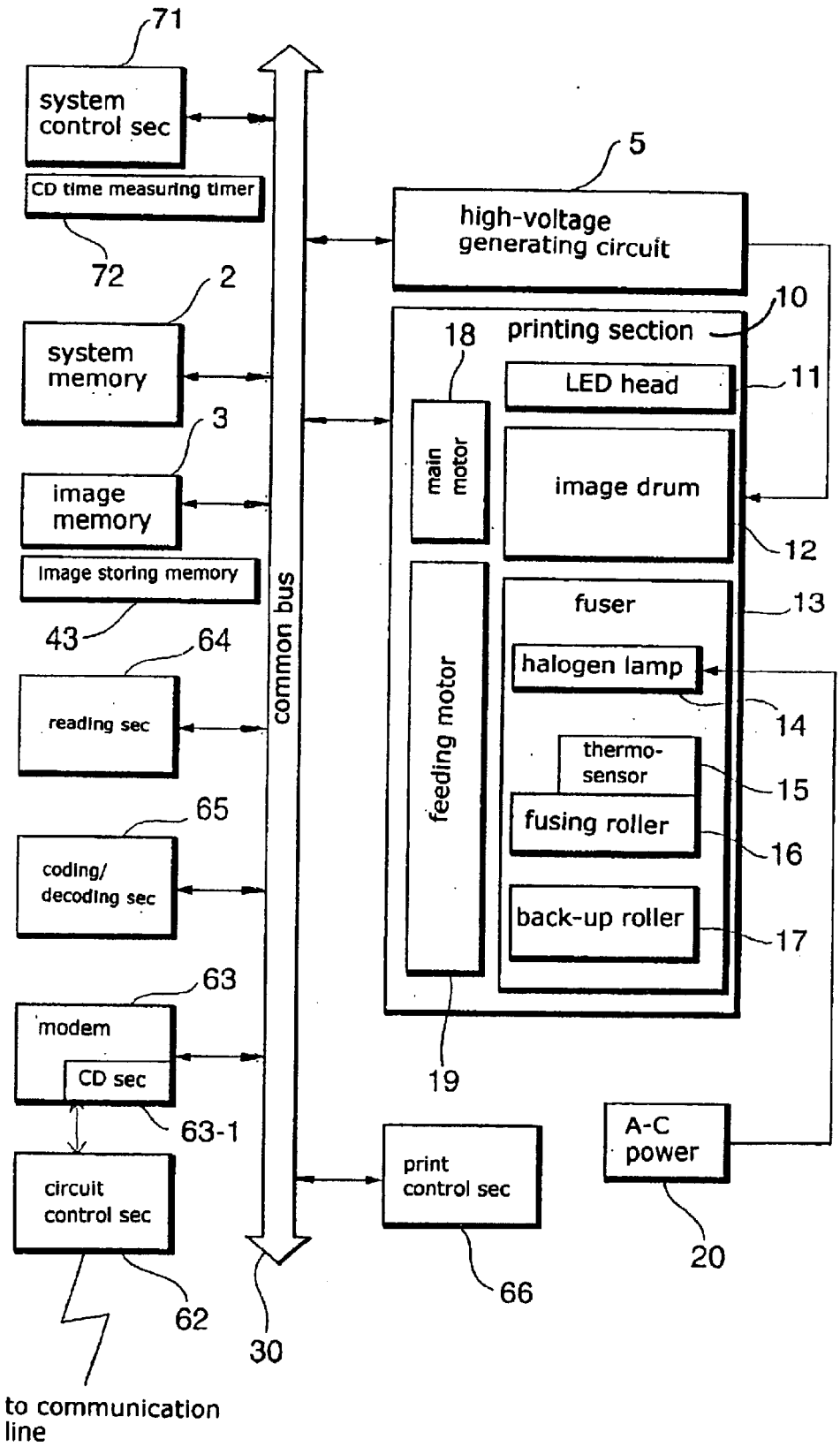
FIG. 12 is a block diagram of the construction of an image forming apparatus according to the sixth embodiment.

In FIG. 12, to realize each of the means, the image forming apparatus comprises a system memory 2, an image memory 3, a high-voltage generating section circuit 5, a printing section 10, an A-C power 20, a common bus 30, an image storing memory 43, a circuit control section 62, a modem 63, a reading section 64, a coding/decoding section 65, a print control section 66, a system control section 71, and a CD time measuring timer 72. The printing section 10 includes an LED head 11, an image drum 12, a fuser 13, a main motor 18, and a feeding motor 19. The only difference from the first and third embodiments will be described below.

The system control section 71 (CPU) controls the entire image forming apparatus according to the sixth embodiment. In the printing process, it mainly controls the carrier detecting means F1, CD continuation time measuring means F2, input signal converting means E1, print starting means A3, CD continuation evaluating means F3, and memory changing means C3. The means are operated according to a program pre-stored in the system memory 2. Details of individual means are described below.

The Carrier Detecting Means F1:

This is a means for detecting a carrier (transmission carrier wave) for a facsimile signal. A carrier detector is usually disposed.

The CD Continuation Time Measuring Means F2:

This is a means for measuring the continuation time of the carrier. A CD time measuring timer is usually used for the purpose.

The Input Signal Converting Means E1:

This is a means for receiving a facsimile communication signal which is modulated with the carrier (transmission carrier wave) and sent from a partner's facsimile machine, demodulating the modulated signal, converting the demodulated signal to the printing information, and converting the printing information to the image data. The system control section 71 controls the circuit control section 62, modem 63, and coding/decoding section 65.

The Print Starting Means A3:

This is a means for starting the printing process by decoding the printing information to produce the image data, temporarily storing the image data in the image memory 3, and reading out the image data line by line in a main scanning direction. Part of the printing process is allotted to the print control section 66.

The Carrier Detecting (CD) Continuation Time Evaluating Means F3:

This is a means for evaluating, for example, the degree of the congestion in the communication line so that the image data is stored in the image storing memory 43 instead of the image memory 3 when the continuation time of the carrier is larger than a predetermined value.

The Memory Changing Means C3:

This is a means for storing the image data in the image storing memory 43 instead of the image memory 3. This means is provided to avoid the intermission of the image data in the middle even when the facsimile communication signal is intermitted in the middle due to the heavy congestion of the communication line. That is, the printing process is suspended and all the printing information is decoded into the image data and once stored in the image storing memory 43 having large capacity. Then, the image data is read out from the image storing memory 43, thereby to avoid the intermission of the image data.

The CD time measuring timer 72 executes the CD continuation time measuring means F2 to measure the continuation time of the carrier. The other means are the same as those of the first, third, and fifth embodiments and the description thereof will be omitted.

In FIG. 11, the image forming apparatus according to the sixth embodiment is operated in accordance with steps S(6)1–S(6)12.

The Step S(6)1:

The system control section 71 sets a protocol in accordance with a procedure of the facsimile communication.

The Step S(6)2:

The modem 63 starts receiving the facsimile communication signal from the communication line.

The Step S(6)3:

A CD section 63-1 in the modem 63 detects the carrier and generates a status signal to show the detection of the carrier. The carrier detecting means F1 continues to monitor the status signal until the step S(6)7.

The Step S(6)4:

The CD time measuring timer 72 recognizes the status signal and starts to increase the count of time.

The Step S(6)5:

The input signal converting means E1 in the system control section 71 controls the modem 63 to demodulate the facsimile communication signal that is modulated with a carrier wave and sent from a partner's facsimile machine, converts the demodulated signal to the printing information, and further to the image data. The circuit control section 62, modem 63, and coding/decoding section 65 executes the step S(6)5 according to the control of the system control section 71.

The Step S(6)6:

The print starting means A3 in the system control section 71 starts the printing process by decoding the printing information to produce the image data, temporarily storing the image data in the image memory 3, and reading out the image data line by line in the main scanning direction. Part of the printing process is allotted to the print control section 66.

The Step S(6)7:

When the carrier detecting means F1 detects no carrier any more (when there is no status signal any more), the process advances to the next step.

The Step S(6)8:

The CD time measuring timer 72 stops counting, temporarily stores the number of the count, and resets the timer to zero to prepare for the next measurement.

The Step S(6)9:

The CD continuation time evaluating means F3 in the system control section 71 advances the process to the step S(6)10 when the stored number of count (continuation time of the carrier) is smaller than the predetermined value, and advances the process to the step S(6)11 when the stored number of count is larger than the predetermined value.

The Step S(6)10

The print continues and the flow is finished.

The Step S(6)11:

The fusing heater turn-off means A7 in the print control section 66 controls the halogen lamp 14, thermosensor 15, fusing roller 16, and back-up roller 17, to stop the supply of a-c electric power from the A-C power 20 to the fuser 13.

The Step S(6)12:

The memory changing means C3 in the system control section 71 stores the image data in the image storing memory 43 instead of the image memory 3 and finishes the flow.

The above-described operation is usually executed according to the system program that is pre-stored in the system memory 2. However, the invention is not limited to that. An individual control circuit for each means may be employed to execute the process. The respective means have been grouped to either the system control section 71 or the print control section 66 to simplify the description. However, each means may not be clearly grouped to either control section, because both the control sections operate integrally as a unit.

It is possible to connect the control method of the first or second embodiment after step S(6)10 to reduce the power consumption of the fuser 13. Also, the control method after step S(3)9 of the third embodiment may be connected after step S(6)10 to reduce the power consumption of the fuser 13. In addition, the image memory 3 in step S(5)2 of the fifth embodiment may be changed to the image storing memory 43 to connect to the control method to reduce the power consumption.

(Effects of the Sixth Embodiment)

The image forming apparatus according to the sixth embodiment has the same effects as those of the fifth embodiment even when the image data is not continuously transmitted due to the intermission of the facsimile communication signal in the middle.

What is claimed is:

1. An image forming apparatus comprising:

an image forming section, whereby a toner image is formed onto a print medium;

a fusing section, whereby said toner image is fused and said print medium is fed;

a heater, whereby said fusing section is heated;

a power supplying section, whereby electric power is supplied to said heater; and a print controlling section, whereby a printing process is executed in accordance with input printing information and said supply of electric power to said heater is controlled, said print controlling section detecting specific information indicating an end part of said printing information and stopping said supply of electric power to said heater in response to said detection of said specific information indicating said end part of said printing information.

2. The image forming apparatus according to claim 1, wherein said fusing section fuses an end part of said toner image with remaining heat of said heater after said stop of said supply of electric power.

3. The image forming apparatus according to claim 1, wherein said stop of said supply of electric power is executed at a predetermined time after said detection of said end of said print information.

4. An image forming apparatus comprising:

an image forming section, whereby a toner image is formed onto a print medium;

a fusing section, whereby said toner image is fused and said print medium is fed;

a heater, whereby said fusing section is heated;

a power supplying section, whereby electric power is supplied to said heater; and a print controlling section, whereby a printing process is executed in accordance with input printing information and said supply of electric power to said heater is controlled, said print controlling section detecting an end of said printing information and stopping said supply of electric power to said heater in response to said detection of said end of said printing information, wherein said stop of said supply of electric power is executed at a predetermined time after said detection of said end of said print information and at least a rear end of said toner image formed on said print medium passes through said fusing section before said predetermined time is finished.

5. An image forming apparatus comprising:

an image forming section, whereby a toner image is formed onto a print medium;

a fusing section, whereby said toner image is fused and said print medium is fed;

a heater, whereby said fusing section is heated;

a power supplying section, whereby electric power is supplied to said heater; and a print controlling section, whereby a printing process is executed in accordance with input printing information and said supply of electric power to said heater is controlled, said print controlling section detecting an end of said printing information and stopping said supply of electric power to said heater in response to said detection of said end of said printing information, wherein said print controlling section comprises a printing information analyzing section and a print execution controlling section, said printing information analyzing section analyzing and decoding said printing information to image data to be printed, detecting an end of said image data, and adding a predetermined code at said end of said image data, and said print execution controlling section executing said printing process for said image data in accordance with said analysis by said printing information analyzing section, and detecting said predetermined code to stop said supply of electric power to said heater.

6. The image forming apparatus according to claim 5, wherein said printing information includes information on total pages to be printed and a number of headers attached to each of said total pages, and said printing information analyzing section reads out said information on said total pages and said number of said headers to detect said end of said image data.

7. The image forming apparatus according to claim 6, which further comprises a memory capable of storing all data of said total pages of said image data, wherein said printing information analyzing section comprises:

a header interval measuring subsection, whereby a time interval between input of a header of a first page and input of a header of a second page that is next to said first page is measured;

a header interval comparing subsection, whereby said time interval measured by said header interval measuring subsection and a predetermined time interval are compared to determine which is larger; and a temporary memory setting subsection, whereby said second page of said image data is temporarily stored in said memory when said time interval is larger than said predetermined time interval, wherein said print execution controlling section comprises:

a print suspending subsection, whereby said printing process is temporarily suspended at a temporary storage by said temporary memory setting subsection; and a print resuming subsection, whereby said printing process is resumed after all data of said second page of said image data is stored in said memory.

8. The image forming apparatus according to claim 6, which further comprises a memory capable of storing all data of said total pages of said image data, wherein said printing information analyzing section stores said image data in said memory, detects in sequence said total pages of said image data to be received and said headers of each of said image data, and compares said number of said total pages and said number of said headers to monitor whether said number of said headers becomes equal to a predetermined number, and said print execution controlling section reads out image data stored in said memory to execute said printing process when said number of said headers becomes equal to said predetermined number.

9. An image forming apparatus comprising:

an image forming section, whereby a toner image is formed onto a print medium;

a fusing section, whereby said toner image is fused and said print medium is fed;

a heater, whereby said fusing section is heated;

a power supplying section, whereby electric power is supplied to said heater; and a print controlling section, whereby a printing process is executed in accordance with input printing information and said supply of electric power to said heater is controlled, said print controlling section detecting an end of said printing information and stopping said supply of electric power to said heater in response to said detection of said end of said printing information, which further comprises an input signal converting section, whereby a facsimile communication signal is received and converted to said printing information, wherein said print controlling section comprises a printing information analyzing section, whereby said printing information is analyzed and decoded to image data to be printed and a print execution controlling section, whereby said printing process is executed in accordance with said analysis by said printing information analyzing section, said printing information analyzing section detecting a transmission end signal and said print execution controlling section stopping said supply of electric power to said heater in response to said detection of said transmission end signal.

10. The image forming apparatus according to claim 9, which further comprises a memory capable of storing all data of said total pages of said image data, wherein said printing information analyzing section comprises:

a transmission carrier wave continuation time measuring subsection, whereby a continuation time of a transmission carrier wave of said facsimile communication signal is measured;

a transmission carrier wave continuation time comparing subsection, whereby said continuation time measured by said transmission carrier wave continuation time measuring subsection and a predetermined continuation time are compared; and a temporary memory setting subsection, whereby said image data of a page to be input hereafter is temporarily stored in said memory when said measured continuation time is larger than said predetermined continuation time, and wherein said print execution controlling section suspends said printing process and stops said supply of electric power to said heater at a temporary storage by said temporary memory setting subsection.

* * * * *